US008100135B2

(12) United States Patent
Laurent

(10) Patent No.: US 8,100,135 B2
(45) Date of Patent: Jan. 24, 2012

(54) HAIR COLORING SYSTEM AND TEST DEVICE CAPABLE OF BEING USED IN SUCH A SYSTEM

(75) Inventor: Florence Laurent, Bois Colombes (FR)

(73) Assignee: L'Oreal S.A., Paris (FR)

( * ) Notice: Subject to any disclaimer, the term of this patent is extended or adjusted under 35 U.S.C. 154(b) by 1500 days.

(21) Appl. No.: 10/563,604

(22) PCT Filed: Jun. 7, 2004

(86) PCT No.: PCT/EP2004/007199
§ 371 (c)(1),
(2), (4) Date: Oct. 16, 2006

(87) PCT Pub. No.: WO2005/013759
PCT Pub. Date: Feb. 17, 2005

(65) Prior Publication Data

US 2007/0180895 A1 Aug. 9, 2007

Related U.S. Application Data

(60) Provisional application No. 60/491,975, filed on Aug. 4, 2003.

(30) Foreign Application Priority Data

Jul. 17, 2003 (FR) ..... 03 08731

(51) Int. Cl.
*A45D 2/00* (2006.01)

(52) U.S. Cl. ..... 132/221

(58) Field of Classification Search ..... 132/221, 132/207–208; 222/187, 209, 562, 563; 401/132, 401/198; 206/730, 732, 733, 735; 604/2–3
See application file for complete search history.

(56) References Cited

U.S. PATENT DOCUMENTS 4,823,946 A 4/1989 Stoeffler et al.
(Continued)

FOREIGN PATENT DOCUMENTS

EP 0 553 534 A1 8/1993
(Continued)

OTHER PUBLICATIONS

International Search Report for PCT/EP04/07199, dated Oct. 26, 2004.
English language abstract of FR 2 487 223, Jan. 29, 1982.
English language abstract of FR 2 487 788, Feb. 5, 1982.

*Primary Examiner* — Todd Manahan
*Assistant Examiner* — Brianne O'Neill
(74) *Attorney, Agent, or Firm* — Finnegan, Henderson, Farabow, Garrett & Dunner, LLP

(57) ABSTRACT

The application relates to a packaging system for a hair coloring product containing: i) at least one container (102) holding a composition comprising at least one hair colorant, said composition forming or intended to form a hair coloring product; and ii) at least one test device (20) designed to perform a patch test and incorporating a tube (21) delimiting an internal space containing a dose of said composition, the tube incorporating an outlet aperture (29) and being arranged to cause said composition to be expelled from said outlet aperture (29) in response to excess pressure within the internal space of the tube or when the latter is vented via at least one passage separate from the outlet aperture (29).

17 Claims, 1 Drawing Sheet

U.S. PATENT DOCUMENTS

Figure 1:
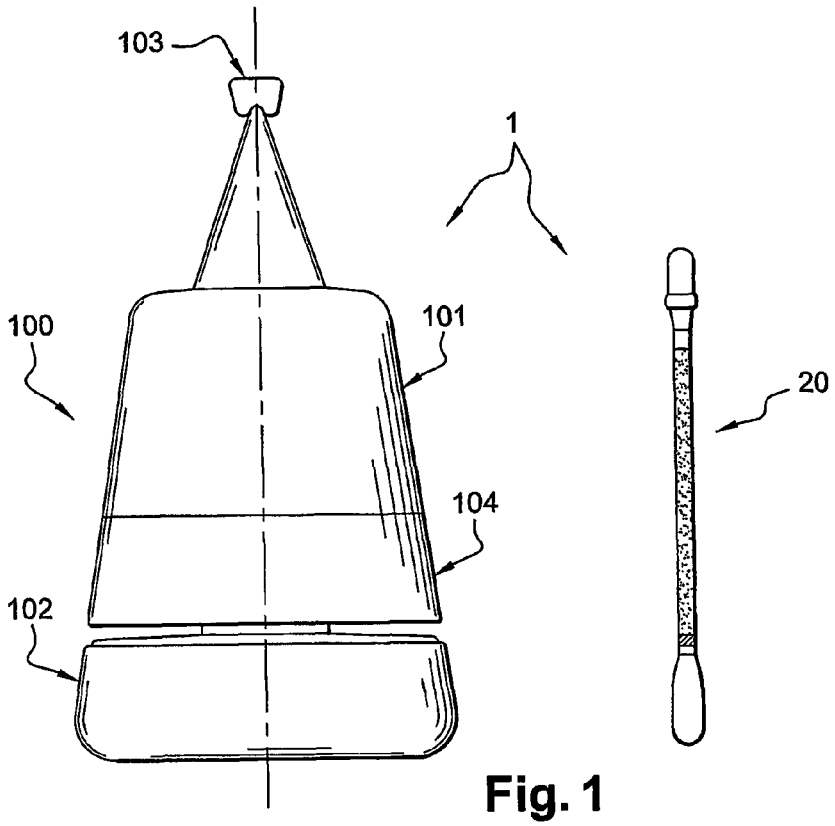

| | | | | |
|---|---|---|---|---|
| 4,875,602 | A | 10/1989 | Chickering et al. | |
| 5,702,035 | A * | 12/1997 | Tsao | 222/187 |
| 5,927,884 | A * | 7/1999 | Kao | 401/132 |
| 6,343,717 | B1 * | 2/2002 | Zhang et al. | 222/209 |
| 6,432,147 | B1 * | 8/2002 | Dias et al. | 8/408 |
| 7,416,355 | B2 * | 8/2008 | Tsaur | 401/119 |
| 2002/0030064 | A1 * | 3/2002 | Lacout | 222/145.1 |
| 2004/0165935 | A1 * | 8/2004 | Kauffmann et al. | 401/196 |

FOREIGN PATENT DOCUMENTS

| | | |
|---|---|---|
| FR | 2 487 223 | 1/1982 |
| FR | 2 487 788 | 2/1982 |
| FR | 2 806 271 A1 | 9/2001 |

* cited by examiner

HAIR COLORING SYSTEM AND TEST DEVICE CAPABLE OF BEING USED IN SUCH A SYSTEM

CROSS REFERENCE TO RELATED APPLICATIONS

This application is a national phase application based on PCT/EP2004/007199 and claims the benefit of U.S. Provisional Application No. 60/491,975, filed on Aug. 4, 2003, and the priority of French Patent Application No. 0308731, filed Jul. 17, 2003, all of which are incorporated herein by reference in their entirety.

The invention discloses a packaging system for a hair coloring product. The invention relates in particular to oxidation coloring or direct coloring. The invention also discloses a test device capable of being used in the system according to the invention.

A sensitivity test (or patch test) of hair coloring products is recommended 48 hours before any hair coloring is applied (oxidation coloring or direct coloring).

Experience has shown, however, that few consumers carry out this test.

One of the reasons cited is that it is not currently practical to carry out this test.

A coloring device equipped with means to enable this patch test to be carried out is described in patent application document FR-A-2 806 271.

Although satisfactory in many respects, the solution described in this document presents the drawback that it requires substantial modification of the packaging containing the coloring product itself. This modification increases its cost to a significant degree.

One of the objects of the invention is also to propose a packaging system for a hair coloring product that wholly or partially remedies the problems described above.

A particular object of the invention is to propose a hair coloring system which enables a patch test of the coloring product to be carried out in a simple and economical manner before the product is applied.

A further object is to propose such a system which facilitates the performance of a patch test of the coloring product and which does not require significant modification of the coloring product packaging.

A further object of the invention is to provide a test device capable of being used in a hair coloring system according to the invention.

Further objects of the invention will become apparent from the detailed description which follows.

According to the invention, these objects are achieved by proposing a packaging system for a hair coloring product containing:

i) at least one container holding a coloring composition forming or intended to form a hair coloring product; and ii) at least one test device designed to perform a patch test and incorporating a tube delimiting an internal space containing at least one hair colorant of said coloring composition, the tube incorporating an outlet aperture, the test device being arranged in a manner such that the contents of the tube are expelled via said outlet aperture in response to excess pressure within the internal space of the tube or when the latter is vented via at least one passage separate from the outlet aperture.

The term "hair colorant" means a direct colorant or a coloring precursor such as an oxidation base or a coupling agent, that is soluble in a hair coloring medium formed by water or a mixture of water and at least one organic solvent.

Advantageously, a liquid or solid plug is arranged inside the tube, said plug serving to isolate the outlet aperture from the internal space of the tube, the plug being arranged to discharge together with the contents of the tube via the outlet aperture when the internal space of the tube is vented or in response to excess pressure inside the latter. The plug closes off the outlet aperture in the absence of excess pressure inside the tube or while the internal space of the tube is not vented. This feature is particularly advantageous in that it facilitates use of the test device when the outlet aperture is associated with an applicator tip.

Alternatively, for the purpose of expelling the contents of the tube, the outlet aperture passes from the closed position to the open position by means of a snap-off tip or by any other means of closure associated with the tube.

In the variant using excess pressure, the latter can be generated conventionally, in the manner of a syringe, by means of a plunger system moving slidably inside the tube. It is to be noted that this variant using excess pressure is not preferred compared to the venting variant, mainly because of its cost and complexity. Furthermore it is not as easy to use by the subject to be tested compared to the venting variant.

The volume of hair composition in the tube can be between 0.01 ml and 5 ml, preferably 0.05 ml and 1 ml.

The tube can be made of a transparent or colored material, in particular a plastics material. Transparency can for example allow the user to observe the level of product in the tube.

The tube can have a multi-layer structure, with at least one layer forming a barrier vis-à-vis the air, for example a layer of varnish impermeable to the air or to a solvent or anti-UV.

Advantageously, venting of the internal space of the tube is effected via an element that can be severed, detached, perforated or deformed, and which is located opposite the outlet aperture.

Preferably, the patch test device comprises an element to hold the breakable part on the tube after it has been severed, in particular in the form of a tab of residual material or a piece of cotton.

More preferably, the tube is fitted with an applicator element, this applicator element being separated from the contents of the tube prior to use by any means, in particular by means of a plug of liquid or powder.

The applicator element may be chosen from a group comprising: a cotton tip, a brush, a foam tip, a felt pad, a flock tip, or an end-piece made of ceramic or sintered material.

In the embodiments incorporating a plug, the latter may be formed by any inert liquid or solid that is non-miscible with the contents of the tube and compatible with the latter. This may in particular be a liquid insoluble in the composition containing the hair colorant and which does not react with the latter. It must be capable of being readily expelled from the tube at the time of use, and must also be physiologically acceptable. The plug serves in particular to isolate the test product from the air, to prevent its evaporation, and to prevent outside contaminants from entering the tube.

The quantity of liquid or powder forming the plug is small relative to that of the tube contents.

The plug may include a liquid, the latter being chosen preferably from the group comprising: mineral oils, fluorinated products, and silicones.

Alternatively the plug consists of a solid, preferably a powder, the latter being chosen from the group comprising: microsphere powders of copolymers, Nylon®, waxes, silicas, and silicones.

The hair coloring composition may be a direct coloring composition. It typically contains one or more direct colorants customarily used in hair coloring.

The term "direct colorant" means a colored and coloring molecule having an affinity for keratinic fibers and soluble in a hair coloring base medium formed by water or a mixture of water and at least one organic solvent.

This or these direct colorant(s) can be non-ionic, anionic, cationic, or amphoteric in nature. They may be chosen for example from nitro-benzene based direct colorants, anthraquinone-based direct colorants, triarylmethane-based direct colorants, and xanthenic, azoic and methinic direct colorants.

Alternatively, the hair coloring composition is an oxidation coloring composition containing at least one oxidation colorant. Oxidation colorants may be bases and/or coupling agents.

In the latter case, the system according to the invention may include a first test device containing an oxidation base present in the oxidation coloring composition, and a second test device containing a coupling agent present in the oxidation coloring composition, this solution having the advantage of being able to test the sensitizing nature of the base and the coupling agent separately.

The system may additionally comprise a container holding an oxidizing composition to be mixed with the coloring composition in order to obtain said hair coloring product.

Suitable oxidation bases include para-phenylenediamines, para-aminophenols, ortho-aminophenols, and heterocyclic bases such as pyridine, pyrimidine or pyrazole bases.

Suitable coupling agents include meta-aminophenols, meta-phenylenediamines, meta-diphenols, naphthols, heterocyclic coupling agents such as indol coupling agents, benzomorpholine coupling agents, pyridine coupling agents, and sesamol derivatives.

The hair coloring composition can be formulated with any customary oxidation coloring or direct coloring base medium capable of flowing freely under its own weight (liquid, fluid gel, or fluid cream).

This base medium may simply be water, with the possible addition of one or more solvents and one or more reducing agents and/or antioxidants.

The hair coloring composition advantageously contains at least one compound selected from surfactants and solvents other than water.

The solvent agent is preferably selected from mono-alcohols such as, for example, ethanol or isopropanol, polyols such as, for example, glycerol or the propylene glycol, or ethers of these mono-alcohols or these polyols such as, for example, propylene glycol monomethyl ether.

The surfactant(s) is (are) selected from non-ionic, anionic, cationic or amphoteric surfactants. They are preferably selected from polyoxyalkylene compounds such as, for example, polyoxyethylenes, polyoxypropylenes, or polyglycerols.

Hair coloring compositions suitable for use in the context of the present invention have been described in detail on numerous occasions, in particular in the patent literature. They do not therefore require additional detailed description.

According to another aspect of the invention, a device capable of being used in the system according to the invention is proposed. The device comprises a tube delimiting an internal space containing at least one direct colorant, the tube incorporating an outlet aperture, the test device being arranged to cause the contents of the tube to be expelled from said outlet aperture of said tube when the latter is vented via at least one passage separate from the outlet aperture.

According to another aspect of the invention, a device capable of being used in the system according to the invention is proposed. The device comprises a tube delimiting an internal space containing at least one hair colorant and at least one compound selected from solvents, preferably other than water and surfactants, the tube incorporating an outlet aperture, the test device being arranged to cause the contents of the tube to be expelled from said outlet aperture of said tube when the latter is vented via at least one passage separate from the outlet aperture.

According to a further aspect of the invention, a device capable of being used in the system according to the invention is proposed. The device comprises a tube delimiting an internal space containing at least one oxidation base and/or at least one coupling agent, the tube incorporating an outlet aperture, the test device being arranged to cause the contents of the tube to be expelled from said outlet aperture of said tube when the latter is vented via at least one passage separate from the outlet aperture.

Advantageously, a liquid or solid plug is arranged inside the tube, said plug serving to isolate the outlet aperture from the internal space of the tube, this plug being arranged to discharge together with said composition via the outlet aperture when the internal space of the tube is vented.

The device may be used independently of the system, in particular by a hairdresser in his/her salon.

According to another aspect, the invention relates to the use of a test device including a tube delimiting an internal space containing:

i) either at least one direct colorant, ii) or at least one hair colorant and at least one compound chosen from solvents and surfactants, iii) or at least one oxidation base and/or at least one coupling agent, the tube having an outlet aperture, the device being arranged so that the contents of the tube are expelled via said outlet aperture in response to excess pressure in the internal space of the tube, or when the latter is vented via at least one passage separate from the outlet aperture, for testing the sensitivity of a subject, prior to a hair treatment with a hair coloring product.

Figure 2:
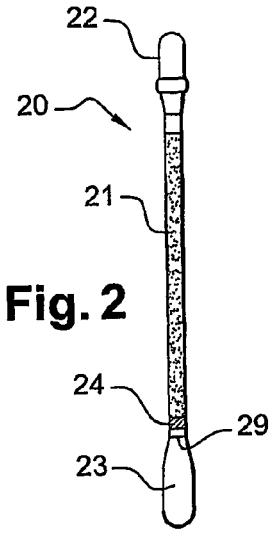
Figure 3:
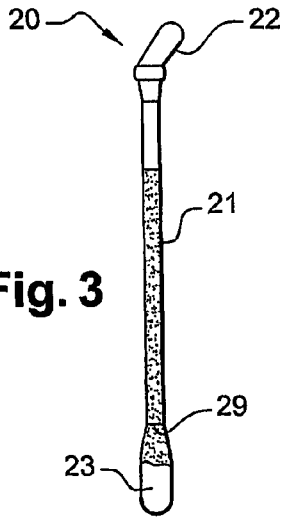
Figure 4:
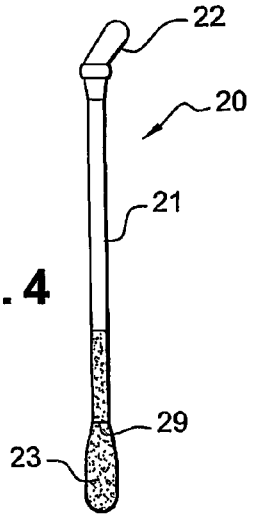

Apart from the arrangements described above, the invention includes a certain number of other arrangements which will be explained below, in relation to non-limitative embodiments, described in reference to the attached drawings wherein:

FIG. 1 illustrates a hair coloring kit according to a particular embodiment of the invention; and FIGS. 2-4 illustrate the principal stages in the operation of the test device contained in the coloring kit of FIG. 1.

FIG. 1 illustrates an oxidation coloring system 1 comprising a) a packaging and applicator device 100 for an oxidation coloring product; and b) a test device 20 according to a preferred embodiment of the invention. This device will be described in detail with reference to the attached FIGS. 2-4.

The oxidation coloring system 100 may in particular be of the type as described in U.S. Pat. No. 4,823,946.

It comprises a first container 101 holding an oxidation composition, and a second container 102 holding the coloring composition. The first container 101 incorporates an applicator tip of which one end 103 can be cut off.

In the storage position illustrated in FIG. 1, the container 101 is above the container 102, the plug in the latter being inserted into a passage formed by an intermediate part 104 intended to link the two containers.

By way of example, the oxidation coloring composition held in the container 102 comprises:

| | |
|---|---|
| Polyglycerol oleic alcohol with 2 moles of glycerol | 4 g |
| Polyglycerol oleic alcohol with 4 moles of glycerol (78% M.A) | 5.69 M.A. |
| Oleic acid | 3.0 g |
| Oleylamine 2 OE marketed as ETHOMEEN O 12 by AKZO | 7 g |
| Diethylaminopropyl laurylamino succinamate, sodium salt 55% M.A. | 3 g M.A. |
| Oleic alcohol | 5 g |
| Oleic acid diethanolamide | 12 g |
| Propylene glycol | 3.5 g |
| Ethyl alcohol | 7.0 g |
| Dipropylene glycol | 0.5 g |
| Propylene glycol monomethylether | 9 g |
| Sodium metabisulfite in aqueous solution at 35% M.A. | 0.455 g M.A. |
| Ammonium acetate | 0.8 g |
| Antioxidant, sequestering | q.s. |
| Perfume, preserving | q.s. |
| Ammonia 20% NH3 | 10 g |
| 1,4-diamino-benzene | 3.1 g |
| 1-hydroxy 2-amino-benzene | 0.315 g |
| 1,3-dihydroxybenzene | 0.6 g |
| 1-hydroxy 3-aminobenzene | 0.95 g |
| 1-beta-hydroxyethyloxy 2,4-diaminobenzene | 0.7 g |
| Demineralised water q.s.p. | 100 g |

When applying the color, the second container 102 is placed in engagement with the first 101, after first removing the cap. By rotating the containers relative to each other, mixing of the respective contents is facilitated.

The device 100 is shaken vigorously so as to homogenize the mixture.

The breakable tip 103 attached to the container 101 is then snapped off. The mixture is then applied in the conventional manner.

Although not illustrated in the drawing, the kit 1 may additionally include a certain number of accessories, in particular a pair of gloves. It generally also includes user instructions, a shampoo or a final treatment.

According to another preferred embodiment (not shown), the coloring composition and the oxidizing composition are packaged in two separate containers or packages the contents of which are mixed manually, preferably in the container holding the oxidizing composition, which container is fitted with a detachable cap forming an applicator tip with a breakable end part. Once mixing has been completed in the container holding the oxidizing composition, it is applied in the conventional manner.

FIGS. 2 to 4 separately illustrate a test device 20 according to a preferred embodiment of the invention, designed to be used before the coloring product itself is applied.

For example, this may be an applicator such as that described in U.S. Pat. No. 5,702,035, the content of which is incorporated herein by reference. Applicators of this type are marketed by the Californian company Swabplus Inc.

The applicator 20 includes a tube 21 containing a coloring composition identical to that held in the container 102 of the coloring system described above. The tube does not contain any other composition; in particular, it does not contain an oxidation composition.

In the system illustrated, the tube is made by extrusion of transparent plastics material and is provided with a breakable part 22 at a closed end. In the example under consideration, this end is covered by a cotton tip. The tube 21 is open at the end opposite the breakable part 22 via an outlet aperture 29. The open end is fitted with an applicator element 23.

In the example shown, the applicator element 23 includes a cotton tip, in the manner of a cotton stick.

The coloring product is contained in an internal space in the tube 21 located between the breakable part 22 and a plug 24 present in the tube 21 towards the open end.

The volume of coloring product may vary for example between 0.01 ml and 5 ml, preferably between 0.05 and 1 ml. The outside diameter of the tube 21 is less than 6 mm for example, or less than 3 mm approximately. The inside diameter of the tube 21 may be between approximately 0.5 mm and approximately 3 mm, for example.

The plug 24 can be formed by any inert liquid or solid compatible with the packaging of the product in the tube 21, in particular a liquid that is insoluble in the coloring product and does not react with the latter. The plug must be capable of being readily expelled from the tube 21 at the time of use, and must also be physiologically acceptable. The plug 24 serves in particular to isolate the coloring product from the air, to prevent its evaporation and to prevent the ingress of external contaminants. In the example under consideration, the liquid plug 24 is made of silicone.

The quantity of liquid or powder forming the plug 24 is small relative to that of the coloring product.

When the breakable part 22 is snapped off, air can enter the tube 21 from the side opposite the open end and the coloring product can flow by gravity into the tube 21 and reach the applicator element 23 via the outlet aperture 29, as illustrated in FIGS. 3 and 4, to be applied wholly or partially to a suitable area of skin (behind the ear or in the crook of the elbow).

In the example under consideration, the cotton tip covering the breakable part 22 serves to keep the latter integral with the rest of the tube 21, even after it has been severed.

Before the coloring product is applied, the user carries out a patch test using the device 20 in accordance with the procedure described in reference to FIGS. 2-4.

If the test is successful (no reaction after 48 hours), the user can then proceed to apply the coloring product to the hair in the conventional manner after making up the mixture in accordance with the procedure described in reference to FIG. 1.

According to another embodiment not illustrated, the hair coloring composition is a direct coloring composition marketed in a set including a container holding the direct coloring composition and a test device such as that described in reference to the previous embodiment.

A specimen formula of a direct coloring composition held in the container and in the patch test device is given below:

| | |
|---|---|
| N-lauryl N-carboxymethyl N'-hydroxyethyl N'-carboxymethyl 1,3-diamino propane (36% M.A.) | 9.4595 g |
| Oleocetyl dimethyl hydroxyethyl ammonium chloride (30% M.A.) | 4.7 g |
| Oxyethylene lauryl alcohol (12 OE) | 9.35 g |
| Glycol distearate | 1 g |
| Oxyethylene diethylethanolamine cocoate (4.5 OE) | 2.135 g |
| Lactic acid | 0.92 g |
| Sodium carboxymethyl cellulose | 1.2 g |
| Perfume | q.s. |
| 1-hydroxy 2-amino 4,6-dinitro-benzene | 1.1 g |
| 1,4-diamino 2-nitro-benzene | 0.33 g |
| Demineralised water | q.s.p. 100 g |

In the foregoing detailed description reference is made to preferred embodiments of the invention. It is evident that variants thereto can be proposed without departing from the spirit of the invention as claimed herebelow.

The invention claimed is:

1. A hair coloring system comprising:

i) at least one container holding a coloring composition for forming a hair coloring product, said composition comprising at least one hair colorant; and ii) at least one test device designed to perform a test and comprising a tube having a sealed internal space containing at least one hair colorant of the coloring composition, the at least one hair colorant in the at least one test device being fluidly discrete from the at least one hair colorant in the at least one container;

wherein the tube incorporates an outlet aperture, and wherein the test device is arranged such that the contents of the tube are expelled from the outlet aperture by the excess pressure within the internal space of the tube or when the tube is vented via at least one passage separate from the outlet aperture; and wherein a liquid or solid plug is arranged inside the tube to isolate the outlet aperture from the internal space of the tube, and wherein the plug is arranged such that it is discharged together with the contents of the tube via the outlet aperture when the internal space of the tube is vented or in response to excess pressure inside the tube.

2. A system according to claim 1, wherein the volume of hair colorant contained in the tube ranges from 0.01 ml to 5 ml.

3. A system according to claim 2, wherein the volume of hair colorant contained in the tube ranges from 0.05 ml to 1 ml.

4. A system according to claim 1, wherein said venting of the internal space of the tube is effected by a breakable element that can be severed, detached, perforated, or deformed, and which is located opposite the outlet aperture.

5. A system according to claim 4, wherein the test device further comprises a component to support the breakable element on the tube after it has been severed.

6. A system according to claim 5, wherein said component is in the form of a tab of residual material or a piece of cotton.

7. A system according to claim 1, wherein the tube is fitted with an applicator element wherein an applicator element is separated from the contents of tube prior to use by the liquid or solid plug.

8. A system according to claim 7, wherein the applicator element is chosen from a cotton tip, a brush, a foam tip, a felt pad, a flock tip, and an end-piece made of ceramic or sintered material.

9. A system according to claim 1, wherein the plug comprises a liquid chosen from mineral oils, fluorinated products, and silicones.

10. A system according to claim 1, wherein the plug is a solid.

11. A system according to claim 10, wherein the solid plug is a powder chosen from microsphere powders of copolymers, Nylon®, waxes, silicas, and silicones.

12. A system according to claim 1, wherein the coloring composition is an oxidation coloring composition comprising at least one oxidation colorant.

13. A system according to claim 1, further comprising an additional container holding an oxidizing composition to be mixed with the coloring composition in order to obtain the hair coloring product.

14. A system according to claim 1, wherein the coloring composition is a direct coloring composition comprising at least one direct colorant.

15. A system according to claim 12, wherein the coloring composition comprises at least one hair colorant and at least one compound chosen from surfactants and solvents other than water.

16. A system according to claim 14, wherein the coloring composition comprises at least one hair colorant and at least one compound chosen from surfactants and solvents other than water.

17. A method for testing the sensitivity of a subject to a hair coloring product before treatment with said hair coloring product, said method comprising:

providing at least one container and a test device, at least one hair colorant being in the container, the test device comprising a tube having a sealed internal space containing i) at least one hair colorant chosen from direct colorants;

ii) at least one hair colorant and at least one compound chosen from solvents and surfactants; or iii) at least one hair colorant chosen from oxidation bases and coupling agents, and applying said hair coloring product to a test location on said subject with the test device wherein the at least one hair colorant in the test device is fluidly discrete from the at least one hair colorant in the at least one container;

wherein said tube incorporates an outlet aperture, said test device being arranged such that the contents of the tube are expelled from the outlet aperture in response to excess pressure in the internal space of the tube or when the tube is vented via at least one passage separate from the outlet aperture, and wherein a liquid or solid plug is arranged inside the tube to isolate the outlet aperture from the internal space of the tube, and wherein the plug is arranged such that it is discharged together with the contents of the tube via the outlet aperture when the internal space of the tube is vented via the at least one passage separate from the outlet aperture or in response to excess pressure inside the tube.

* * * * *